US008795474B2

(12) United States Patent
Lang

(10) Patent No.: US 8,795,474 B2
(45) Date of Patent: Aug. 5, 2014

(54) PULP MOULDED PLATE AND PREPARATION APPARATUS THEREOF

(76) Inventor: Qi Lang, Kiaoning (CN)

( * ) Notice: Subject to any disclaimer, the term of this patent is extended or adjusted under 35 U.S.C. 154(b) by 0 days.

(21) Appl. No.: 13/883,998

(22) PCT Filed: Nov. 2, 2011

(86) PCT No.: PCT/CN2011/081666

§ 371 (c)(1),
(2), (4) Date: May 8, 2013

(87) PCT Pub. No.: WO2012/062172

PCT Pub. Date: May 18, 2012

(65) Prior Publication Data

US 2013/0228301 A1 Sep. 5, 2013

(30) Foreign Application Priority Data

Nov. 11, 2010 (CN) ..... 2010 1 0542001

(51) Int. Cl.
*D21J 3/10* (2006.01)
*D21J 7/00* (2006.01)

(52) U.S. Cl.
CPC ..... *D21J 3/10* (2013.01); *D21J 7/00* (2013.01)
USPC ..... 162/382; 162/385; 162/389; 425/84; 425/177; 425/180

(58) Field of Classification Search
CPC ..... D21J 7/00; D21J 5/00; D21F 13/00
USPC ..... 162/382, 385, 387–389, 392–397, 401, 162/405, 407–408, 415–416; 425/84–85, 425/177, 180
See application file for complete search history.

(56) References Cited

U.S. PATENT DOCUMENTS

| | | | | | |
|---|---|---|---|---|---|
| 2,754,729 | A * | 7/1956 | Emery | 162/199 |
| 2,777,367 | A * | 1/1957 | Ednell | 162/229 |
| 2,922,476 | A * | 1/1960 | Koxvold | 162/392 |
| 3,936,251 | A * | 2/1976 | Billey | 425/38 |
| 5,064,504 | A * | 11/1991 | Shetka | 162/396 |
| 2013/0228301 | A1 * | 9/2013 | Lang | 162/231 |

FOREIGN PATENT DOCUMENTS

| | | | |
|---|---|---|---|
| CN | 2647905 | Y | 10/2004 |
| CN | 2663497 | Y | 12/2004 |
| CN | 101070688 | A | 11/2007 |
| CN | 101634124 | A | 1/2010 |
| CN | 101985820 | A | 3/2011 |
| GB | 2330552 | A | 4/1999 |
| WO | WO 2007022695 | A1 * | 3/2007 |

OTHER PUBLICATIONS

PCT Search Report and Written Opinion dated Feb. 2, 2012 of PCT Application No. PCT/CN2011/081666 filed Nov. 2, 2011, 11 pages.

* cited by examiner

*Primary Examiner* — Jose Fortuna
(74) *Attorney, Agent, or Firm* — Maine Cernota & Rardin

(57) ABSTRACT

An apparatus for the preparation of pulp molded plate includes a press and a three-piece mold including an upper die (1), a surrounding frame (2) and a lower die (3), wherein one of the dies is a moving die and the other is a fixed die, and lower die is always within the press, and moves in relation to the upper and lower dies. The apparatus also includes a rigid matrix and a flexible punch with a retractable die bar, which are installed respectively on the upper die and lower die, so as to prepare a heterotypic pulp-molded plate with a convex part. Also disclosed is a pulp molded plate prepared by this preparation apparatus.

14 Claims, 7 Drawing Sheets

PULP MOULDED PLATE AND PREPARATION APPARATUS THEREOF

FIELD OF THE INVENTION

The present invention relates to an apparatus for producing pulp molded plate and a special-shaped pulp molded plate produced by the same and having a convex part, (i.e., a concave-convex structure).

BACKGROUND OF THE INVENTION

There are favorable economic and social benefits that the plates and special-shaped plates made from pulp may be used as a material for electrical insulation, industrial packaging, building finishing furniture and so on. For example, the Chinese Patent Publication No. CN101070688A described one patent of invention "Method and Mold for Producing Pulp Molded Plates" of the applicant, and the Chinese Patent Publication No. CN101634124 described another patent of invention "Method and Mold for Producing Special-Shaped Pulp Molded Plate having a Convex Part" of the applicant. However, in the implementation of above two patents, it has been found that the following two aspects should be improved under the scope of the two patents:

1. In the aspect of mounting relation between the molds and the press machine, in the first embodiment, the enclosing frame is fixed to the frame of the press machine, the upper mold (referred to as "cover plate" in the publication document) is driven by the upper cylinder of the press machine so as to open and close the upper opening of the enclosing frame, and the lower mold (referred to as "press block" in the publication document) is driven by the lower cylinder of the press machine so as to move up and down within the enclosing frame. There is the problem as follows: in the pressing process, the upper mold needs to balance the pressure from the lower mold, besides, a pressure required for sealing between the upper mold and the enclosing frame must be provided; therefore, the pressure of the upper cylinder of the press machine must be higher than the pressure of the lower cylinder, or the pressure maintaining capability of the upper cylinder must be very high. However, in practice, the pulp often is leaked from the fitting surfaces between the upper mold and the enclosing frame. In the second embodiment, the upper mold is fixedly connected under the press ram of the upper-acting press machine, and which is always moved within the enclosing frame, the enclosing frame is driven by a two-piston hydraulic cylinder so as to move up and down, while the lower mold is fixedly connected to the working platform of the press machine; under such structure, it is difficult to inject pulp into the molds and achieve synchronization between the enclosing frame and the upper mold in the mould splitting process; moreover, there is the biggest disadvantage as follows: the upper mold can't be drained off completely; therefore, at the moment of mold splitting, all residual water in the grooves and holes of the upper mold will flow back to the wet green of work piece, and the moisture content in the wet green will be increased, thereby resulting in: (1) reducing the strength of wet green, which is adverse to the transport and handling of the wet green; (2) increasing the energy consumption of the hot pressing drier and reducing working efficiency thereof.
2. In the aspect of molding technique, with regard to the pulp molded plate having a convex part, when the pressure increases to a certain value in the pressing process, the fiber layer having high water content deposited on the flat part around the convex part is easy to crush, and some paper fibers will be squeezed into the cavity of the female mold at the convex part, thereby causing uneven distribution of paper fibers in the cavity of the female mold; in addition, the defects (e.g., fractures) may form easily around the convex part.

SUMMARY OF THE INVENTION

Considering the requirement for further reducing the cost of pulp molded plate and improving the performance of product with the molding technique utilizing a three-piece mold constituted by upper mold, enclosing frame, and lower mold, the present invention discloses an apparatus for producing pulp molded plate having an optimal structure of three-piece mold; in addition, the present invention discloses a molding apparatus for the convex part of non-flat special-shaped pulp molded plate, so that it may achieve the lower cost, the higher technical performance, and the wider applicability of high-pressure pulp molded plate (product) produced by the method described above.

The technical solution of the present invention is as follows:

An apparatus for producing pulp molded plate, comprising a press machine and a three-piece mold, the three-piece mold comprises an upper mold, an enclosing frame, and a lower mold to form a mold cavity with variable capacity; the molding surface of the upper mold is provided with a drain grooves and is covered by a wire mesh, the molding surface of the lower mold is provided with a drain groove and/or hole, and is covered with a wire mesh, wherein:

one of the upper mold and the lower mold is a movable mold, the other is a fixed mold, and the lower mold is always within the enclosing frame; the enclosing frame is supported by two or more plunger-type cylinders or piston-type cylinders fixed to the press machine, and which is movable relative to the upper mold and the lower mold;

The apparatus further comprises two seal grooves and seal rings inlaid in the seal grooves, the seal rings are arranged on the contact surface between the opening of the enclosing frame and the upper mold, and one or more guiding water grooves are arranged between the two seal grooves; in a pressed state of the upper mold and the enclosing frame, the drain groove on the molding surface of the upper mold is extended to above the guiding water grooves, so as to form a channel with the guiding water grooves.

In that arrangement, any both of the upper mold, enclosing frame and lower mold may be movable relative to each other, and the enclosing frame may be movable up and down.

Further, when a upper-acting press machine is used, the upper mold is a movable mold, which is fixed to the lower surface of the press ram of the upper-acting press machine; the lower mold is a fixed mold, which is fixed to the working platform of the upper-acting press machine;

In a initial state, the enclosing frame is supported at the highest position by two or more plunger-type cylinders fixed to the working platform of the press machine;

In a working state, the upper mold is driven by the press ram of the press machine to move down, contact with the enclosing frame, form pressed sealing, and thereby push the enclosing frame to move down; that is to say, the downward movement of the enclosing frame is accomplished as a result that the upper mold contacts with the enclosing frame and transfers the pressure of the press machine to the enclosing frame so that the hydraulic oil in the at least two plunger-type cylinders supporting the enclosing frame overflows under pressure; and thereby the pressing force required for sealing between the enclosing frame and the upper mold is also provided.

Moreover, the upward movement of the enclosing frame may be accomplished by means of at least two telescoping handle; the telescoping handle is inserted in an unthreaded hole of the enclosing frame and is slide-fitted with the unthreaded hole; and the lower end of the telescoping handle passes through a fastener or a stepped shaft, and the outer diameter of the fastener or the stepped shaft is greater than the diameter of the unthreaded hole of the enclosing frame, so as to prevent the telescoping handle from pulling out of the unthreaded hole; the upper end of the telescoping handle is fixed to the upper mold or the press ram of the press machine.

Another solution may be: when a lower-acting press machine is used, the lower mold is a movable mold, which is fixed to a press ram of the lower-acting press machine, or which is fixed directly to the piston rod end or plunger end of the main cylinder of the lower-acting press machine; the upper mold is a fixed mold, which is fixed to the lower surface of the upper beam of the lower-acting press machine; an upward and downward movement of the enclosing frame is accomplished by means of two or more piston-type cylinders fixed to the press machine, and thereby a pressing force required for sealing between the enclosing frame and the upper mold is provided.

The process for producing pulp molded plate with the apparatus described above, comprises a step of soaking a pulp plate or a waste paper and then smashing them to produce a pulp at a concentration≤6%, a step of squeezing out water and molding with a three-piece mold, and a step of demolding and drying; the upper mold and enclosing frame in the three-piece mold may be movable relative to each other, so as to open or close the upper opening, of the enclosing frame; the lower mold may be movable towards the upper mold within the enclosing frame relatively, so as to squeeze the water out of the pulp for forming.

When the pulp molded plate is a special-shaped pulp mold product having a convex part, the squeezing out water for forming of the convex part may be accomplished by a method of using a flexible male mold, i.e., when enough paper fibers have been deposited on the surface of a rigid female mold at the convex part, the flexible male mold placed in the center of the rigid female mold and having a variable shape and having the smallest initial radial dimension may be controlled to expand in radial direction, to exert a pressure to the deposited paper fiber layer containing high water content around the convex part, so as to accomplish the water squeezing out and forming procedure for the convex part, wherein:

The apparatus further comprises a rigid female mold and a flexible male mold matching the rigid female mold, both of which are coaxially mounted on the upper mold and the lower mold respectively;

The ratio of a height to a minimum aperture of the rigid female mold is greater than 0.6;

The flexible male mold is connected to the lower mold or the upper mold via a telescopic mold column, which is nested and connected to the flexible male mold; a support spring is mounted on the other end of the mold column, the mold column is inserted in the hole on the lower mold or the upper mold arranging the flexible male mold, so as to form movable fitting and a movable sealing with the hole, and the cross section of the mold column matches the horizontally projected shape of the flexible male mold after expansion.

In a initial state, the mold column is supported at the extended limit position by the support spring, while a certain length of mold column is exposed out the hole on tire lower mold or the upper mold; in a working state, i.e., in the process of that the upper mold and the lower mold move towards each other relatively, the end of the flexible male mold reaches the bottom of the rigid female mold and squeezes the paper fiber layer deposited there; when the sum of a pressure exerted on the flexible male mold and the mold column exceeds the sum of the initial tension force of the support spring and seal friction resistance, the support spring is compressed; as the pressure exerted on the flexible male mold and the mold column increases, the exposed part of the mold column reduces gradually, till the mold column enters into the hole completely; in that process, the sealed spaces between the flexible male mold, the support spring, the mold column and the hole on the respective mold is compressed, and the flexible male mold is expanded from the initial radial dimension to the maximum radial dimension.

Further, the flexible male mold is constituted by fitting a capsular sheath made of an elastomeric material over a mold core made of a rigid material; the mold core has perforated liquid pore passages;

The mold column is hollow to form a syringe with variable capacity with a receiving hole on the lower mold or upper mold; the syringe is communicated with the liquid pore passages of the mold core, and is filled with the liquid.

In a initial state, the mold column is supported at a position allowing a maximum capacity of the syringe cavity by the support spring, and the liquid is fully drawn into the syringe cavity; in a working state, as the mold column and the lower mold or upper mold move towards each other relatively, and thereby the capacity of the syringe cavity is reduced, the liquid in the syringe cavity will be forced into the capsular sheath, therefore the capsular sheath will be expanded; in the reverse process, as the mold column and the respective mold move away from each other in the reverse direction, the liquid in the capsular sheath will be drawn back into the syringe cavity, and therefore the capsular sheath will be recovered to its original shape.

Another solution may be the flexible male mold is a solid part made of an elastomeric material.

In a initial state, the radial dimension of the flexible male mold is the smallest, and the height there of is the highest; in a working state, as the mold column and the respective mold move relative to each other in the pressing process, the counter force of the support spring of the mold column will cause deformation of the flexible male mold made of an elastomeric material, and therefore the height will decrease, while the radial dimension will increase (the volume will remain constant substantially).

When the apparatus described above is used to produce pulp molded plate and non-flat special-shaped pulp molded plate, the procedures and the devices involved are shown in the following table:

| No. | Name of Procedure | Description of Procedure | Devices and Molds Involved | Remarks |
|---|---|---|---|---|
| 1 | Pulp preparation | Soak a pulp plate or a waste paper and then smash them to produce a pulp at concentration ≤6% | Hydraulic pulp shredder, pulp pump, etc. | Any adhesive is not required. |

-continued

| No. | Name of Procedure | Description of Procedure | Devices and Molds Involved | Remarks |
|---|---|---|---|---|
| 2 | Pulp injection | Inject the prepared pulp into the mold | A three-piece mold constituted of a upper mold, a lower mold, and a enclosing frame; Pulp pump, valve, etc. | |
| 3 | Forming (the convex part and the non-convex part are formed at the same time) | Mold pressing, squeeze out water and forming (further including squeezing out water and forming of the convex part by means of a rigid female mold and a flexible male mold with a telescopic mold column) | Press machine, air compressor; A three-piece mold constituted of a upper mold, a lower mold, and a enclosing frame; (further including a rigid female mold and a flexible male mold with a telescopic mold column) | |
| 4 | Transferring wet green | Take out molded wet green from the mold | Mechanical arm | |
| 5 | Sizing by hot pressing | Drying and setting in hot mold | Press machine Hot pressing mold | |

A non-flat special-shaped pulp molded plate produced with the apparatus described above, having one or more convex part, wherein:

The ratio of a height to a minimum aperture of the convex part on the pulp molded plate is greater than 0.6;

In addition, a maximum density $\rho_{max}$ and a minimum density $\rho_{min}$ of the convex part satisfy: $(\rho_{max}-\rho_{min})/\rho_{max}<0.2$;

In the pulp molded plate, the density is greater than 0.69/$cm^3$ and the thickness is 2-20 mm.

Moreover, the plate is in a tray shape formed integrally with plank and leg by high-pressure water squeezing out, and the density is 0.6-1.3 g/$cm^3$, and the thickness of the plank is 5-15 mm, the ratio of a height to a aperture of the legs is greater than 0.8.

Compared to the prior art, the present invention has apparent advantages as follows:

(1) The solution of the movable enclosing frame in the present invention (i.e., the enclosing frame is movable, and one of the upper mold and the lower mold is movable, the other is fixed, and the lower mold is within the enclosing frame) overcomes the drawbacks in the prior art, i.e., in the prior art, though the enclosing frame is movable, the upper mold is within the enclosing frame; therefore, the water can't be drained from the upper mold completely, and the residual water will flow back to the wet green after mold splitting, and it is difficult to achieve synchronization between the enclosing frame and the upper mold its the mold splitting process; or, the enclosing frame is fixed, and both of the upper mold and the lower mold are movable, and the upper opening of the enclosing frame is sealed by the upper mold; the upper mold needs to balance the pressure from the lower mold, besides, a pressure required for sealing between the upper mold and the enclosing frame must be provided, therefore, the pressure of the upper cylinder of the press machine must be greater than the pressure of the lower cylinder, or the pressure maintaining capability of the upper cylinder must be very high.

(2) In the present invention, the flexible male mold having a telescopic mold column enters into the cavity of the female mold prior to the pressure of squeezing arrives to a specified value, and the flexible male mold expands gradually in radial direction as the upper mold and the lower mold move relative to each other; such arrangement successfully overcomes a technical difficulty in production of special-shaped pulp molded plate having a convex part in the prior art, i.e., in the pressing process, when the pressure increases to the specified value, the deposited paper fiber layer containing high water content around the convex part will be crushed, and some paper fibers will be squeezed into the cavity of the female mold, around the convex part, thereby causing uneven distribution of paper fibers in the cavity of the female mold; in addition, a fractures may occur around the convex part;

(3) The special-shaped pulp molded plate having a convex part and the goods tray products described in the present invention may be a model in the circular economy, owing to its characteristics, such as production from pure wastepaper, high density, high strength, and infinitely repeating the process of "recycling-molding-use-recycling again" theoretically; in addition, the process of production has the environmental protection, the low carbon, and the low cost characteristics.

Figure 1:
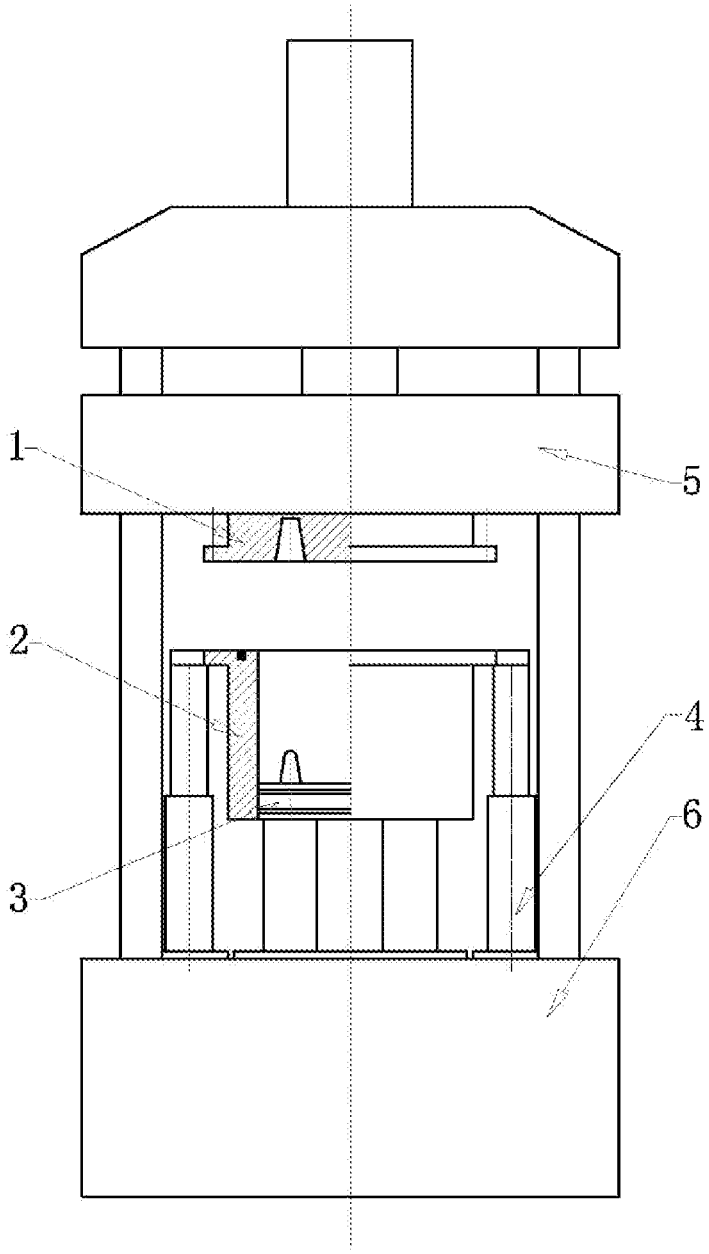
FIG. 1 is a schematic structural diagram of an embodiment of the present invention, in which a upper-acting press machine is used.

In the drawings: 1—upper mold; 2—enclosing frame; 3—lower mold; 4—plunger-type hydraulic cylinder for supporting the enclosing frame; 5—press ram of upper-acting press machine; 6—working platform of upper-acting press machine; 7—piston-type hydraulic-cylinder for supporting and raising/lowering the enclosing frame; 8—upper beam of lower-acting press machine; 9—piston rod of main cylinder of lower-acting press machine; 10—rigid female mold;

11—capsular sheath; 12—mold core; 13—liquid pore passage; 14—liquid; 15—mold column; 16—cavity of syringe; 17—spring; 18—solid flexible male mold; 21—convex part; 25—plank; 26—leg; 31—seal ring and seal groove between the upper mold and the enclosing frame; 32—guiding water groove; 33—drain grooves evenly distributed on the surfaces of upper mold; 34—wire mesh; 35—telescoping handle; 36—smooth holes on the enclosing frame; 37—lower nut of the telescoping handle

DETAILED DESCRIPTION OF THE EMBODIMENTS

Embodiment 1

Hereunder the apparatus for producing pulp molded plate in the present invention will be detailed with reference to FIG. 1, in which it mainly relates to the mounting relation between the three-piece mold and a upper-acting, press machine: the main cylinder of the upper-acting press machine is mounted on an upper beam of the press machine, and the piston rod in the main cylinder pushes tire press ram 5 of the press machine to move downwards in the pressing process. The upper mold 1 of the three-piece mold is fixed to the lower surface of the press-ram 5 by using the T-blocks and bolts and utilizing the T-slots on the lower surface of the press ram, and the upper mold moves up and down with the press ram 5; the enclosing frame 2 is supported by at least two plunger-type hydraulic cylinders 4 fixed to the working platform 6 of the press machine, and it utilizes the plunger-type hydraulic cylinders 4 to provide pressure required for sealing between the enclosing frame and the upper mold; when the upper mold 1 moves down to seal the upper opening of the enclosing frame 2, and pushes the enclosing frame 2 and the plungers of the hydraulic cylinders 4 to move downwards together, the hydraulic oil in the plunger-type hydraulic cylinders 4 will be forced to drain at a preset pressure, so that the pressure required for sealing between the enclosing frame 2 and the upper mold 1 is provided, and the enclosing frame 2 may descend steadily; the lower mold 3 is fixed to the working platform 6 of the press machine, and moves in relation, to the enclosing frame 2 and upper mold 3, and which is always fitted within the enclosing frame 2.

The upward movement of the enclosing frame 2 is accomplished by means of jacking action of the hydraulic cylinder 4 or lifting action of the upper mold 1 by a set of slidable rod; in case the enclosing frame 2 is lifted by means of the upper mold 1, the plunger end of the hydraulic cylinder 4 may be separated from the enclosing frame 2, after the enclosing frame 2 is lifted to a specified height, the plunger of the hydraulic cylinder 4 may jack up to fit the enclosing frame 2.

Figure 7:
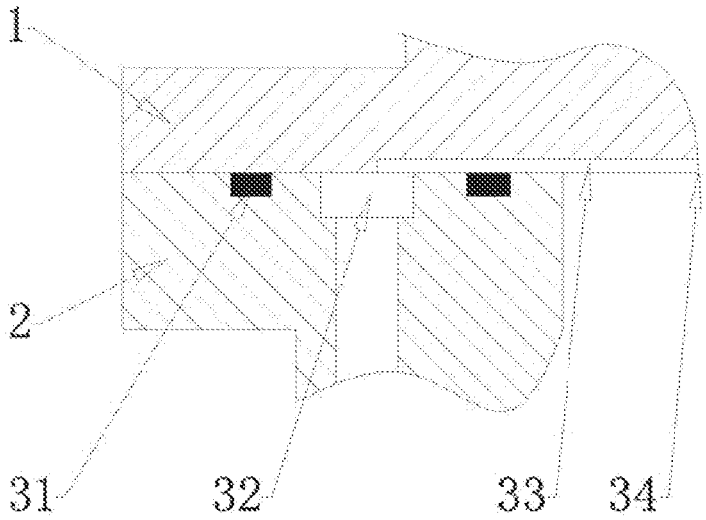
FIG. 7 is a schematic diagram of the draining structure of the upper mold and the sealing structure between the upper mold and the enclosing frame.

Hereunder the draining structure of the upper mold 1 and the sealing structure between the upper mold 1 and the enclosing frame 2 will be further detailed with reference to FIG. 7: the enclosing frame 2 is provided with two seal grooves 31 inlaying seal rings around the opening of the enclosing frame on the contact surfaces with the upper mold, and one or more guiding water groove 32 is arranged between the seal grooves 31 inlaying seal rings; in a compressed state of the upper mold 1 and enclosing frame 2, the drain grooves 33 evenly distributed on the working surfaces of the upper mold 1 are extended to above the guiding water groove 32 and form channels with the guiding water grooves 32; and the working surfaces of upper mold and lower mold are covered with a wire mesh 34 respectively.

Figure 8:
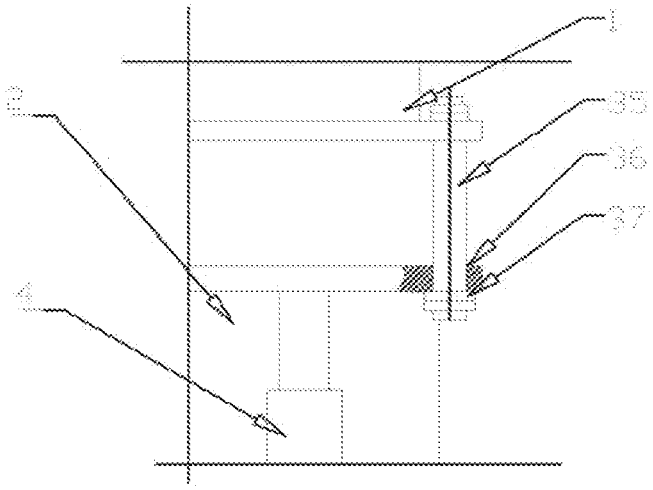
FIG. 8 is a schematic structural diagram of the telescoping handle for raising the enclosing frame.

Alternatively, the raising action of the enclosing frame 2 may be accomplished by means of at least two telescoping handle 35; as shown in FIG. 8, the upper end of the telescoping handle 35 is connected to the upper mold 1 or directly connected to the press ram, when the upper mold 1 returns, the telescoping handle 35 will move synchronously with the upper mold 1; the lower ends of the telescoping handle 35 are slide-fitted into unthreaded holes 36 on the enclosing frame 2; in the case the enclosing frame 2 is supported by at least two plunger-type hydraulic cylinders 4, when the upper mold 1 moves downwards, the telescoping handle 35 will slide down in the unthreaded holes 36 on the enclosing frame 2, till the upper mold 1 is tightly fitted to the enclosing frame 2; when the upper mold 1 returns, the telescoping handle 35 will slide up in the unthreaded holes 36 on the enclosing frame 2, while the enclosing frame 2 doesn't move; when the round nuts 37 on the lower ends of the telescoping handle 35 is contacted with the lower end faces of the unthreaded holes 36, the enclosing frame 2 will be pulled up. After the upper mold 1 returns to the upper limit position and the enclosing frame 2 is pulled up to certain height, at least two plunger-type hydraulic cylinders 4 will jack up, till they support the enclosing frame 2.

Embodiment 2

Figure 2:
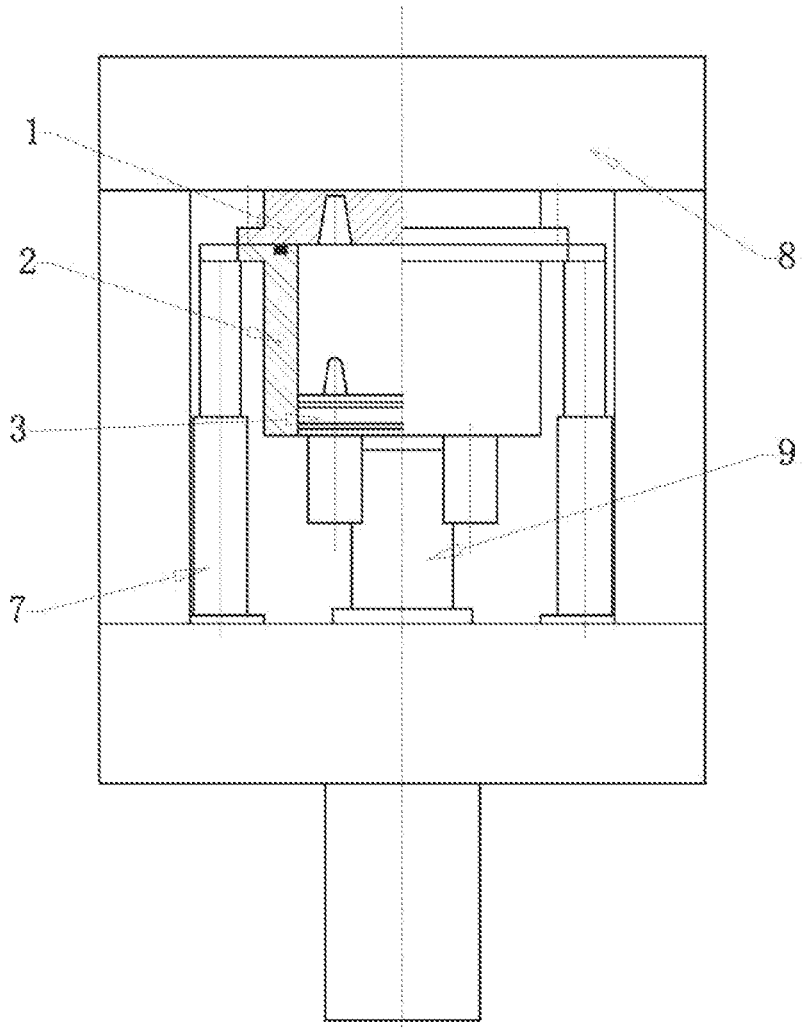
FIG. 2 is a schematic structural diagram of another embodiment of the present invention, in which a lower-acting press machine is used.

Hereunder the apparatus for producing pulp molded plate in the present invention will be further detailed with reference to FIG. 2, in which it mainly relates to the mounting relation between the three-piece mold and a lower-acting press machine; in the case the press machine is lower-acting, the upper mold 1 is fixed to the lower surface of an upper beam 8 of the press machine, the enclosing frame 2 utilizes two piston-type cylinders 7 fixed to the press machine to accomplish the upward and downward movement and provide a pressure required for sealing between the enclosing frame 2 and the upper mold; the lower mold 3 is fixed to the press ram of the press machine, or, as shown in FIG. 2, the lower mold 3 is directly fixed to the end of a piston rod 9 in the main cylinder of the press machine.

Embodiment 3

Figure 3:
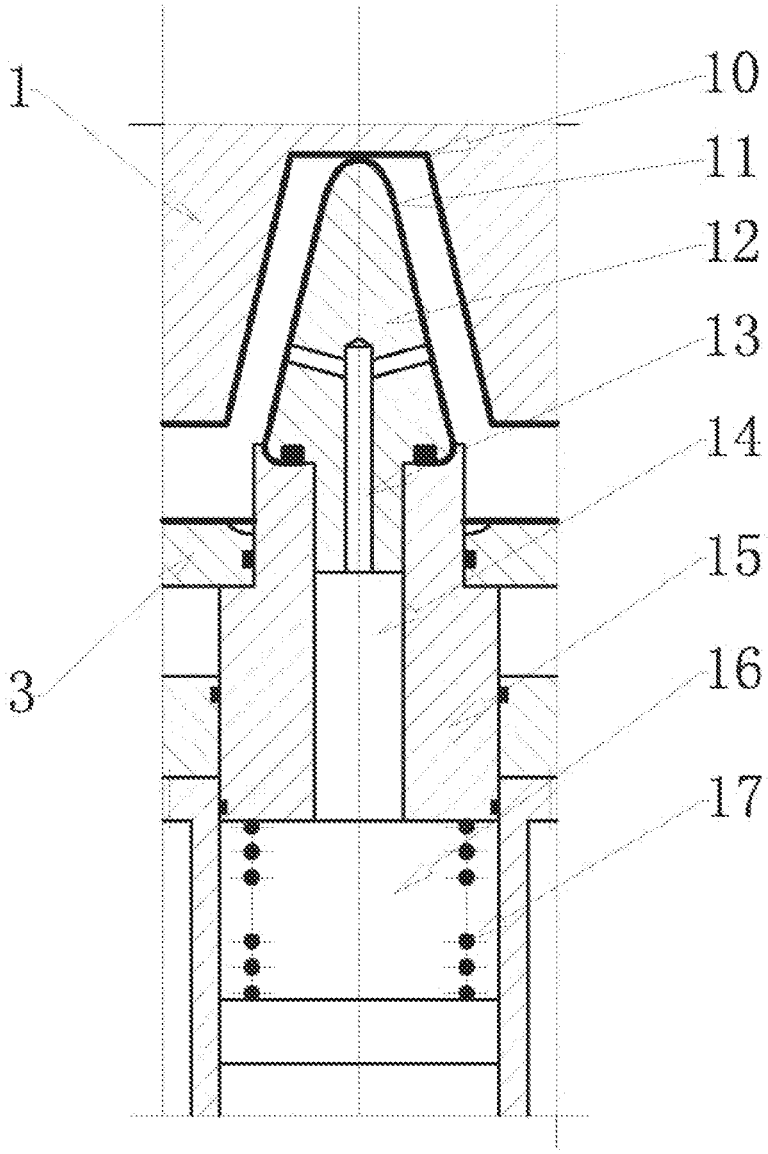
FIG. 3 is a schematic structural diagram of the capsular flexible male mold made of an elastomeric material in the present invention.

Hereunder the molding method for a capsular flexible male mold made of an elastomeric material in the present invention will be further detailed with reference to FIG. 3:

A rigid female mold 10, is mounted on the upper mold 1, and its molding surface is provided with a drain groove and covered with a wire mesh to allow the paper fibers to deposit;

A capsular sheath 11, made of an elastomeric material, is sleeved on a mold core 12 made of a rigid material to form a flexible male mold together with the mold core 12; the flexible male mold is inserted into the upper end of a mold column 15, which has a spring 17 mounted on the bottom and has a cross section substantially in the same shape as the horizontally projected shape of the capsular sheath 11 after expansion, the mold column 15 is inserted into a hole on the lower mold 3 and which is movable fitted, and dynamic sealed with mold column 15, so as to form a syringe cavity 16 having variable capacity and communicating with the capsular sheath 11 through liquid pore passages 13 on the mold core 12; the flexible male mold and mold column 15 are coaxial to the female mold 10.

For a purpose of simplicity, in this embodiment, the horizontal sections of the female mold 10, capsular sheath 11, and mold column 15 are in circular shape, and the diameter of the lower segment of the mold column 15 is larger than the diameter of the upper segment of the mold column 15 slightly, so as to balance fee pretension force of the spring 17.

The syringe cavity 16 is filled with liquid 14; in initial state, the mold column 15 is supported at a position allowing a maximum capacity of the syringe cavity 16 by the spring 17 and the liquid 14 is fully drawn into the syringe cavity 16;

In the initial state, the mold column 15 is supported at an upper limit position by the pretension force of the spring, while a certain length of mold column is exposed out the hole on the lower mold 3; when the upper mold 1 and lower mold 3 move towards each other so that enough paper fibers are deposited on the surface of the rigid female mold 10 at the convex part, the end of the flexible male mold reaches to the bottom of the rigid female mold 10 and begins to squeeze the paper fiber layer there; when the sum of the pressure exerted on the flexible male mold and the mold column 15 exceeds the sum of the pretension force of the spring 17 and the seal friction resistance, the spring 17 under the mold column 15 is compressed; as the pressure, exerted on the flexible male mold and the mold column 15 increases, the exposed part of the mold column 15 will be reduced gradually, till the mold column 15 enters into the lower mold 3 completely;

When tire mold column 15 and the lower mold 3 move towards each other, the liquid 14 in the syringe, cavity 16 will be forced to flow into the capsular sheath 11, so that the capsular sheath 11 is expanded to exert a pressure on the deposited paper fiber layer containing high water content around the capsular sheath 11, so as to accomplish the water squeezing and forming procedure of the convex part. In the reverse process, the mold column 15 and lower mold 3 move away from each other in the reversed direction, and the liquid 14 in the capsular sheath 11 is drawn back into, the syringe cavity 16; as a result, the capsular sheath 11 will be recovered to its original shape.

In the case the rigid female mold 10 is mounted on the lower mold 3, the flexible male mold assembly described above is mounted on the upper mold 1 accordingly.

Embodiment 4

Figure 4:
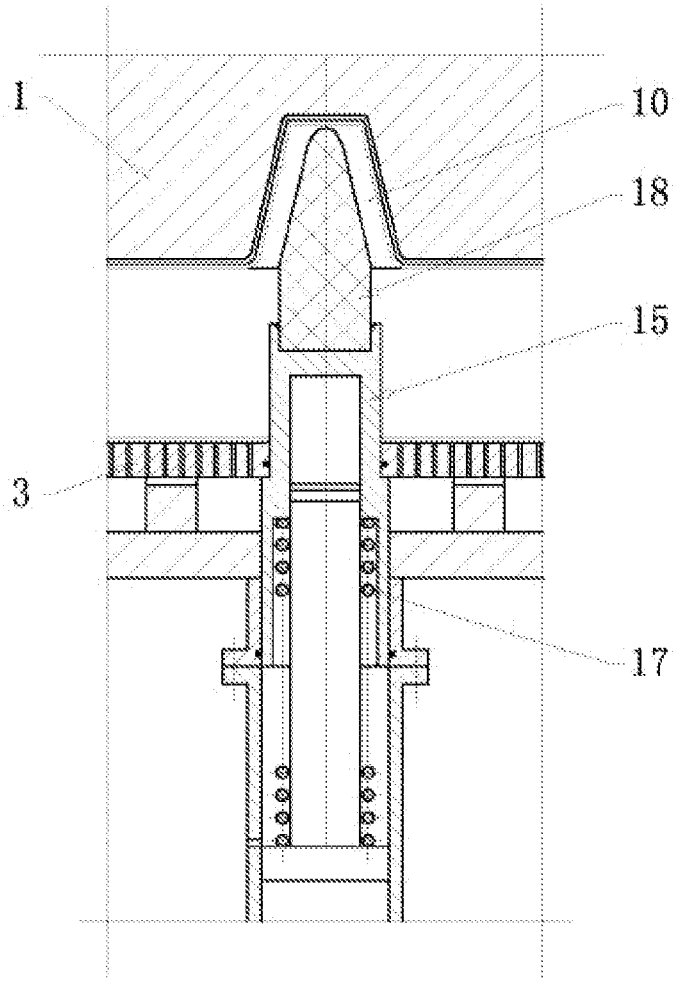
FIG. 4 is a schematic structural diagram of the solid flexible male mold made of an elastomeric material in the present invention.

Hereunder the molding method for a solid flexible male mold made of an elastomeric material in the present invention will be further detailed with reference to FIG. 4:

A rigid female mold 10, is mounted on the upper mold 1, and its molding surfaces is provide with a drain grooves and covered with a wire mesh to allow the paper fibers to deposit;

A solid flexible male mold 18, made of an elastomeric material, is mounted on the upper end of a mold column 15, which has a spring 17 mounted on the bottom and has a cross section substantially in the same shape as the horizontally projected shape of the solid flexible male mold 18 after expansion, the mold column 15 is inserted in a hole on the lower mold 3, and which is movable fitted, and dynamic sealed with, the mold column 15, and the solid flexible male mold 18 and the mold column 15 are coaxial to the female mold 10;

For a purpose of simplicity, in this embodiment, the horizontal sections of the female mold 10, solid flexible male mold 18, and mold column 15 are in circular shape, and the diameter of the lower segment of the mold column 15 is larger than the diameter of the upper segment of the mold column 15 slightly, so as to balance the pretension force of the spring 17;

In the initial state, the mold column 15 is supported at an upper limit position by the pretension force of the spring, while a certain length of mold column is exposed out the hole on the lower mold 3; when the upper mold 1 and lower mold 3 move towards each other so that enough paper fibers are deposited on the surface of the rigid female mold 10 at the convex part, the end of the solid flexible male mold 18 reaches to the bottom of the rigid female mold 10 and begins to squeeze, the paper fiber layer there; when the sum of the pressure exerted on the solid flexible male mold 18 exceeds the sum of the pretension force of the spring 17 and the seal friction resistance, the spring 17 under the mold column 15 is compressed; as the pressure exerted on the solid flexible male mold 18 increases, the exposed part of the mold column 15 will be reduced gradually, till the mold column 15 enters into the lower mold 3 completely;

When the mold column 15 and the lower mold 3 move towards each other, solid flexible male mold 18 made of an elastomeric material is deformed by the counter force of the paper fiber layer on the bottom of the rigid female mold 10 and the counter force of the spring 17 under the mold column 15; the radial dimension thereof increases as reducing of the height (the volume remains constant substantially); therefore, the solid flexible male mold 18 exerts a pressure on the deposited paper fiber layer containing high water content, around the solid flexible male mold 18; in that way, the water squeezing and forming procedure of the convex part is accomplished.

In the case the rigid female mold 10 is mounted on the lower mold 3, the flexible made mold assembly described above is mounted on the upper mold 1 accordingly.

Figure 5:
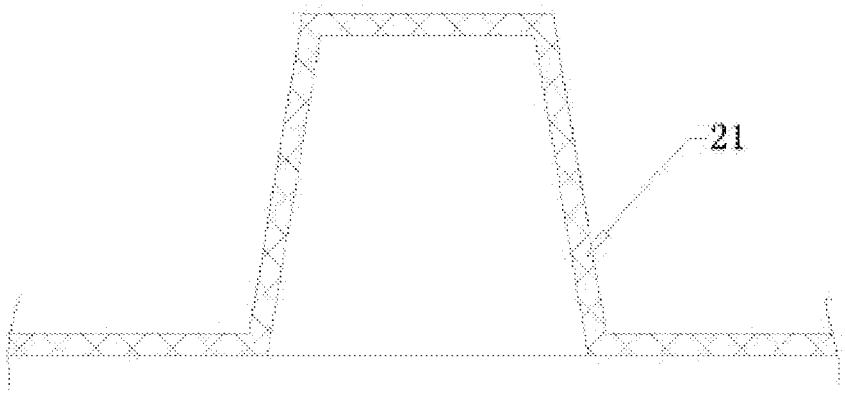
FIG. 5 is an embodiment of special-shaped pulp molded plate with convex part in the present invention.

Hereunder the special-shaped pulp molded plate with convex part in the present invention will be further detailed with reference to FIG. 5.

The pulp molded plate is a special shape of non-flat, which has at least one convex part 21 there on, and the ratio of a height H of the convex part 21 to a minimum aperture d of the convex part 21 is greater than 0.6;

The maximum density $\rho_{max}$ of the convex part and the minimum density $\rho_{min}$ of the convex part satisfy: $(\rho_{max}-\rho_{min})/\rho_{max}<0.2$;

The density of the pulp molded plate is greater than 0.6 g/cm$^3$, and the thickness is 2-20 mm thereof;

What an example to a plate purely made of wastepaper pulp by high-pressure molding (>6 MPa), the convex part is in a circular truncated cone shape, wherein, H=60 mm, d=86 mm, H/d=0.7; $\rho_{avg}$=1.0 g/cm$^3$, $(\rho_{max}-\rho_{min})/\rho_{max}$=(1.03−0.98)/1.03=0.0485; thickness=7 mm.

Figure 6:
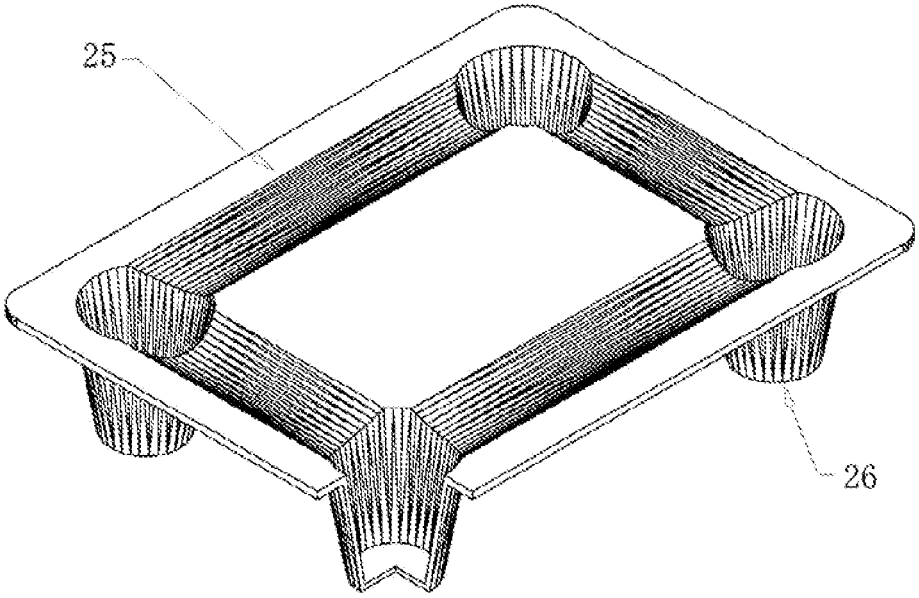
FIG. 6 is an embodiment of tray product in the present invention.

Hereunder a high-pressure pulp molded tray produced with the apparatus described above will further detailed with reference to FIG. 6:

The high-pressure pulp molded tray is a goods tray, which is a special-shaped pulp molded plate having a convex part.

The tray is made of wastepaper, and formed by high-pressure water squeezing, the density is at 0.6-1.3 g/cm$^3$; the thickness of the plank part is 5-15 mm, and the plank 25 and the legs 26 are formed integrally.

The ratio of the height to the aperture of the legs 26 is greater than 0.8;

Hereunder an example of tray is provided. The plank 25 is in 620×470 mm (L×W) dimensions, the tray is in 132 mm total height, the ratio of the height to the aperture of the legs 26 is 1, the density is 1 g/cm$^3$, the plank 25 is in thickness of 6 mm, and the legs 26 are in thickness of 4 mm.

While the present invention has been illustrated and described with reference to some preferred embodiments, the present invention is not limited to these. Those skilled in the art should appreciate that various variations and modifications may be made without, departing from the spirit and scope of the present invention as defined by the accompanying claims.

The invention claimed is:

1. An apparatus for producing pulp molded plate, comprising a press machine and a three-piece mold, the three-piece mold comprises an upper mold, an enclosing frame, and a lower mold to form a mold cavity with variable capacity; the molding surface of the upper mold is provided with a drain groove and is covered by a wire mesh, the molding surface of the lower mold is provided with a drain groove and/or hole and is covered with a wire mesh, wherein:

one of the upper mold and the lower mold is a movable mold, the other is a fixed mold, and the lower mold is always within the enclosing frame; the enclosing frame is supported by two or more plunger-type cylinders or piston-type cylinders fixed to the press machine, and which is movable relative to the upper mold and the lower mold;

the apparatus further comprises two seal grooves and seal rings inlaid in the seal grooves, the seal rings are arranged on the contact surface between the opening of the enclosing frame and the upper mold, and one or more guiding water grooves are arranged between the two seal grooves; in a pressed state of the upper mold and the enclosing frame, the drain groove on the molding surface of the upper mold is extended to above the guiding water grooves, so as to form a channel with the guiding water groove.

2. The apparatus for producing pulp molded plate according to claim 1, wherein:

the upper mold is a movable mold, which is fixed to the lower surface of a press ram of a upper-acting press machine; the lower mold is a fixed mold, which is fixed to a working platform of the upper-acting press machine;

in a initial state, the enclosing frame is supported at the highest position by two or more plunger-type cylinders fixed to the working platform of the press machine;

in a working state, the upper mold is driven by the press ram of the press machine to move downwards, contact with the enclosing frame, form pressed sealing, and thereby push the enclosing frame to move downwards.

3. The apparatus for producing pulp molded plate according to claim 2, wherein:

the apparatus further comprises two or more telescoping handles arranged symmetrically, the telescoping handle is inserted in an unthreaded hole of the enclosing frame and is slide-fitted with the unthreaded hole; and the lower end of the telescoping handle passes through a fastener or a stepped shaft, and the outer diameter of the fastener or the stepped shaft is greater than the diameter of the unthreaded hole of the enclosing frame, so as to prevent the telescoping handle from pulling out of the unthreaded hole; the upper end of the telescoping handle is fixed to the upper mold or the press ram of the press machine.

4. The apparatus for producing pulp molded plate according to claim 1, wherein:

the lower mold is a movable mold, which is fixed to a press ram of a lower-acting press machine, or which is fixed directly to the piston rod end or plunger end of the main cylinder of the lower-acting press machine; the upper mold is a fixed mold, which is fixed to the lower surface of the upper beam of the lower-acting press machine; an upward and downward movement of the enclosing frame is accomplished by means of two or more piston-type cylinders fixed to the press machine, and thereby a pressing force required for sealing between the enclosing frame and the upper mold is provided.

5. The apparatus for producing pulp molded plate according to claim 1, wherein:

the apparatus further comprises a rigid female mold and a flexible male mold matching the rigid female mold, both of which are coaxially mounted on the upper mold and the lower mold respectively;

the ratio of a height to a minimum aperture of the rigid female mold is greater than 0.6;

the flexible male mold is connected to the lower mold or the upper mold via a telescopic mold column, which is nested and connected to the flexible male mold; a support spring is mounted on the other end of the mold column, the mold column is inserted in the hole on the lower mold or the upper mold arranging the flexible male mold, so as to form a movable fitting and a movable sealing with the hole, and the cross section of the mold column matches the horizontally projected shape of the flexible male mold after expansion;

in a initial state, the mold column is supported at the extended limit position by the support spring, while a certain length of the mold column is exposed out the hole on the lower mold or the upper mold; in a working state, i.e., in the process of that the upper mold and the lower mold move towards each other relatively, the end of the flexible male mold reaches the bottom of the rigid female mold and squeezes the paper fiber layer deposited there, the sealed spaces between the flexible male mold, the support spring, the mold column and the hole on the respective mold is compressed, and the flexible male mold is expanded from the initial radial dimension to the maximum radial dimension.

6. The apparatus for producing pulp molded plate according to claim 5, wherein:

the flexible male mold is constituted by fitting a capsular sheath made of an elastomeric material over a mold core made of a rigid material; the mold core is provided with a interconnected liquid pore passages;

the mold column is hollow to form a syringe with variable capacity with a receiving hole on the lower mold or upper mold; the syringe is communicated with the liquid pore passages of the mold core, and is filled with the liquid.

7. The apparatus for producing pulp molded plate according to claim 5, wherein:

the flexible male mold is a solid element made of an elastomeric material.

8. An apparatus for producing pulp molded plate, comprising:

a press machine;

a three-piece mold fixed to the press machine, the three-piece mold comprising an upper mold, an enclosing frame, and a lower mold, forming a mold cavity with variable capacity;

wherein the molding surface of the upper mold is provided with a drain groove and is covered by a wire mesh, the molding surface of the lower mold is provided with a drain groove and/or hole and is covered with a wire mesh;

wherein one of the upper mold and the lower mold is a movable mold, the other is a fixed mold, and the lower mold is always within the enclosing frame;

wherein the enclosing frame is supported by two or more plunger-type cylinders or piston-type cylinders fixed to the press machine, which is movable, relative to the upper mold and the lower mold;

two seal grooves further comprising seal rings inlaid in the seal grooves, wherein the seal rings are arranged on the contact surface between the opening of the enclosing frame and the upper mold; and one or more guiding water grooves, arranged between the two seal grooves during a pressed state of the upper mold and the enclosing frame, wherein the drain groove on the molding surface of the upper mold is extended to above the guiding water grooves, so as to form a channel with the guiding water groove.

9. The apparatus for producing pulp molded plate according to claim 8, wherein:

the upper mold is a movable mold fixed to the lower surface of a press ram of an upper-acting press machine;

the lower mold is a fixed mold, fixed to a working platform of the upper-acting press machine;

wherein, during an initial state, the enclosing frame is supported at the highest position by two or more plunger-type cylinders, fixed to the working platform of the press machine; and wherein, during use, the upper mold is driven by the press ram of the press machine downwards, forcing the upper mold to contact the enclosing frame, forming a seal, and thereby pushing the enclosing frame to move downwards.

10. The apparatus for producing pulp molded plate according to claim 9, wherein:

the apparatus further comprises two or more symmetrically arranged telescoping handles, wherein the telescoping handles are inserted in unthreaded holes of the enclosing frame and in slidable-engagement with the unthreaded hole, a lower end of the telescoping handle passes through a fastener or a stepped shaft, and the outer diameter of the fastener or the stepped shaft is greater than the diameter of the unthreaded hole of the enclosing frame, so as to prevent the telescoping handle from pulling out of the unthreaded hole; and an upper end of the telescoping handle is fixed to the upper mold or the press ram of the press machine.

11. The apparatus for producing pulp molded plate according to claim 8, wherein:

the lower mold is a movable mold fixed to a press ram of a lower-acting press machine, or fixed directly to the piston rod end or plunger end of the main cylinder of the lower-acting press machine;

the upper mold is a fixed mold fixed to the lower surface of the upper beam of the lower-acting press machine; and wherein an upward and downward movement of the enclosing frame is accomplished by means of two or more piston-type cylinders fixed to the press machine, and thereby a pressing force required for sealing between the enclosing frame and the upper mold is provided.

12. The apparatus for producing pulp molded plate according to claim 8, wherein:

the apparatus further comprises a rigid female mold coaxially mounted on the upper mold;

a flexible male mold coaxially mounted on the lower mold and substantially matching the rigid female mold;

wherein the ratio of a height to a minimum aperture of the rigid female mold is greater than 0.6;

wherein the flexible male mold is connected to the lower mold or the upper mold via a telescopic mold column, which is nested and connected to the flexible male mold;

a support spring mounted on an opposite end of the telescopic mold column, the mold column being inserted in the hole on the lower mold or the upper mold, wherein the mold column is attached to the flexible male mold, so as to form a movable fitting and a movable sealing with the hole, and the cross section of the mold column matches the horizontally projected shape of the flexible male mold after expansion; and wherein, in a initial state, the mold column is supported at the extended limit position by the support spring, while a certain length of the mold column is exposed by the hole on the lower mold or the upper mold; during use, the end of the flexible male mold reaches the bottom of the rigid female mold and squeezes a paper fiber layer deposited there, and the sealed spaces between the flexible male mold, the support spring, the mold column and the hole on the respective mold are compressed, and the flexible male mold is expanded from the initial radial dimension to the maximum radial dimension.

13. The apparatus for producing pulp molded plate according to claim 12, wherein:

the flexible male mold comprises a capsular sheath, made of an elastomeric material, fixed over a mold core, made of a rigid material;

the mold core is provided with interconnected liquid pore passages; and the mold column is hollow, forming a syringe of variable capacity, with a receiving hole on the lower mold or upper mold; and the syringe is in communication with the liquid pore passages of the mold core, and is filled with the liquid.

14. The apparatus for producing pulp molded plate according to claim 12, wherein the flexible male mold is a solid element made of an elastomeric material.

* * * * *

UNITED STATES PATENT AND TRADEMARK OFFICE

CERTIFICATE OF CORRECTION

PATENT NO. : 8,795,474 B2
APPLICATION NO. : 13/883998
DATED : August 5, 2014
INVENTOR(S) : Qi Lang It is certified that error appears in the above-identified patent and that said Letters Patent is hereby corrected as shown below:

On the title page item 76, Inventor City "Kiaoning" should read "Liaoning".

In the specification

Column 4, line 8, "tire" should read "the", Column 5, line 47, "its" should read "in".

Column 7, line 22, "tire" should read "the", Column 8, line 67, "fee" should read "the", Column 9, line 21, "tire" should read "the".

Signed and Sealed this
Second Day of February, 2016

Michelle K. Lee

Michelle K. Lee
*Director of the United States Patent and Trademark Office*